US006624128B1

(12) United States Patent
Smiley

(10) Patent No.: US 6,624,128 B1
(45) Date of Patent: Sep. 23, 2003

(54) WATER MISCIBLE COMPOSITION CONTAINING A CARBOXYLIC ACID DIESTER AND A FATTY ACID SALT

(75) Inventor: Robert A. Smiley, Wilmington, DE (US)

(73) Assignee: Dixie Chemical Company, Pasadena, TX (US)

( * ) Notice: Subject to any disclaimer, the term of this patent is extended or adjusted under 35 U.S.C. 154(b) by 149 days.

(21) Appl. No.: 09/822,088

(22) Filed: Mar. 30, 2001

(51) Int. Cl.[7] ..... C11D 3/43; C11D 7/26

(52) U.S. Cl. ..... 510/201; 510/407; 510/417; 510/202; 510/505; 510/506; 134/38

(58) Field of Search ..... 510/407, 417, 510/202, 201, 365, 505, 506, 484; 134/38

(56) References Cited

U.S. PATENT DOCUMENTS

| | | | | | |
|---|---|---|---|---|---|
| 4,780,235 | A | | 10/1988 | Jackson | 510/212 |
| 5,080,831 | A | * | 1/1992 | VanEenam | 510/365 |
| 5,084,200 | A | | 1/1992 | Dishart et al. | 510/175 |
| 5,230,821 | A | | 7/1993 | Larson et al. | 510/417 |
| 5,354,492 | A | | 10/1994 | Short | 510/188 |
| 5,415,800 | A | | 5/1995 | Motsenbocker | 510/201 |
| 5,672,579 | A | | 9/1997 | Diaz et al. | 510/405 |
| 6,358,901 | B1 | * | 3/2002 | Joye et al. | 510/201 |
| 6,423,677 | B1 | * | 7/2002 | Van Eenam | 510/365 |
| 2002/0068680 | A1 | * | 6/2002 | Smiley | |

FOREIGN PATENT DOCUMENTS

| | | |
|---|---|---|
| WO | WO 99/06520 | 2/1999 |

* cited by examiner

*Primary Examiner*—Gregory E. Webb
(74) *Attorney, Agent, or Firm*—Locke Liddell & Sapp LLP

(57) ABSTRACT

An aqueous water miscible composition composed of carboxylic acid diesters and a fatty acid salt. The fatty acid salt may be represented by the formula:

$$R_1COO^-X^+ \quad (I)$$

wherein $R_1$ is a $C_6$ to $C_{19}$ hydrocarbyl group, optionally substituted with one or more hydroxyl or $C_1$–$C_5$ hydrocarbyl groups; and X is ammonium or an alkali metal. The carboxylic acid diester may be represented by the formula:

$$ROOC(CH_2)_nCOOR' \quad (II)$$

wherein R and R' are independently selected from a $C_1$ to $C_8$ alkyl group and n is from 1 to 8.

11 Claims, No Drawings

WATER MISCIBLE COMPOSITION CONTAINING A CARBOXYLIC ACID DIESTER AND A FATTY ACID SALT

SPECIFICATION

1. Field of the Invention

The invention relates to biodegradable, nontoxic compositions which can be used for cleaning hard surfaces such as metal, wood, and plastic and can also be used for removing paint from metal and wood. After cleaning a surface, the surface can be rinsed with water to remove any residual solvent since the composition is water miscible.

2. Background of the Invention

The prior art contains a multitude of compositions for cleaning hard surfaces, such as metal and wood. For example, U.S. Pat. Nos. 5,084,200; 5,230,821; 5,415,800; and 5,672,579 disclose cleaning compositions containing a mixture of dimethyl esters of succinic acid, glutaric acid and adipic acid. Such compositions have further been disclosed for use as paint removers in U.S. Pat. No. 4,780,235. While such compositions do exhibit desirable biodegradability properties, they have limited water solubility, typically about 5% at room temperature. As a result, it is necessary to include additional components, such as surfactants, emulsifiers and organic solvent solubilizers to make the compositions acceptable as cleansers.

WO 99/06520 discloses aqueous microemulsions for cleaning applications containing dibasic esters. Such compositions exhibit two disadvantages. First, they include emulsifiers which are expensive. Second, the dibasic esters come out of solution when the composition is diluted with water.

Compositions suitable for cleaning hard surfaces such as metallic, wood and plastic surfaces are desired which are miscible with water at room temperature and which do not require the addition of surfactants, emulsifiers and organic solvent solubilizers.

SUMMARY OF THE INVENTION

An aqueous composition suitable for cleaning hard surfaces, such as a metallic, wood, and plastic, contains at least one carboxylic acid diester and at least one fatty acid salt. The carboxylic acid diester may be represented by the formula:

$$R_1COO^-X^+ \quad (I)$$

wherein $R_1$ is a $C_6$ to $C_{19}$ hydrocarbyl group, optionally substituted with one or more hydroxyl or $C_1$–$C_5$ hydrocarbyl groups; and X is ammonium or an alkali metal. The carboxylic acid diester may be represented by the formula:

$$ROOC(CH_2)_nCOOR' \quad (II)$$

wherein R and R' are independently selected from a $C_1$ to $C_8$ alkyl group and n is from 1 to 8. The composition may be prepared by dissolving the carboxylic diester in a saturated solution of the fatty acid salt.

The composition of the invention is water miscible at room temperature and temperatures above room temperature.

In addition to being non-toxic and biodegradable, the composition of the invention is inexpensive to prepare and being miscible with water does not require the addition of expensive surfactants, emulsifiers and solubilizers to render the composition water soluble. In addition, since the composition of the invention does not require regulated solvents, one would expect no restrictions on shipping or storage.

DETAILED DESCRIPTION OF PREFERRED EMBODIMENTS

The fatty acid salt of the aqueous composition of the invention may be represented by the formula:

$$R_1COO^-X^+ \quad (I)$$

wherein $R_1$ is a saturated or unsaturated $C_6$ to $C_{19}$ hydrocarbyl (preferably a $C_7$ to $C_{11}$ hydrocarbyl), optionally substituted with one or more hydroxyl or $C_1$–$C_5$ hydrocarbyl groups and X is ammonium, ($NH_4$), or an alkali metal. Preferred as the component of formula (I) are salts of $C_{10}$ fatty acids such as octanoic acid (caprylic), nonanoic acid (pelargonic) and decanoic acid (capric) as well as mixtures of such salts. This compound contains less than 0.5 wt. % free fatty acids. More preferred, component (I) contains less than 0.1 wt. % free fatty acids. In a most preferred embodiment, component (I) contains essentially no free fatty acids. The fatty acid salt is a saturated aqueous composition, generally Typically, the amount of component (I) in the aqueous composition of the invention is between from about 25 to about 35 weight percent, preferably about 28 to about 32, weight percent, more preferably from about 29 to about 31, weight percent. The amount of water in the composition of the invention is between from about 45 to about 60 weight percent.

The carboxylic acid diester is of the formula:

$$ROOC(CH_2)_nCOOR' \quad (II)$$

wherein R and R' are independently selected from a $C_1$ to $C_8$ alkyl group and n is from 1 to 8. R and $R^1$ on any given compound may be the same or different alkyl group. In a preferred embodiment, n is between 2 and 6, preferably 2 to 4, most preferably 3 to 4.

Highly preferred as compounds for use in the invention are those wherein R and R' are the same alkyl group. R and $R_1$ preferably are a $C_1$ to $C_6$, most preferably a $C_1$ to $C_4$, alkyl group.

The amount of carboxylic acid diester in the composition is generally between from about 15 to about 25, preferably between from about 20 to about 25 weight percent.

Diesters of succinic acid, glutaric acid and adipic acids (such as the dimethyl diesters) are particularly preferred since their corresponding diacids are readily and easily available. For instance, such substances occur in nature. Succinic acid may be found in fungi and lichens; glutaric acid in green sugar beets and water extracts of crude wool while adipic acid is found in beet juice. In addition, adipic acid is often added to foods, such as Jello, as an acidulant. Further, such substances may be found as mixed by-products of the manufacture of nylon intermediates. Such mixtures are considered waste products and that portion that is not used to make esters for solvents or used for scrubbing flue gas from power plants is frequently burned. Also the acid portion of these esters can be derived from other lower and higher molecular weight dibasic acids, such as oxalic, malonic, pimelic, and azelaic acids and mixtures thereof.

The diesters are derived from alcohols such as ethyl, propyl, isopropyl, butyl and amyl and mixtures thereof. Preferred esters are the dimethyl, diethyl, diisopropyl and dibutyl esters.

The composition of this invention may further contain a mixture of two or more of the carboxylic acid diesters of component (II) as well as two or more of the salts of component (I). Particularly favorable results have been seen with a composition containing, as component (II), a mixture containing diesters of glutaric, adipic and succinic acids. Particularly preferred results are obtained with a diester blend containing about 15 to about 25 weight percent succinate diester, between from about 55 to about 75 weight percent glutarate diester and between from about 10 to about 25 weight percent adipate diester.

The composition of the invention is miscible in water. Any solvent in which the composition is miscible with water may further be employed as a diluent. As such, the composition of the invention may be diluted with any quantity of water without precipitation of the carboxylic diester.

The solvents most desired for use in the invention are of two types. One is a functional group-containing solvent which can have the effect of increasing removal effectiveness on a particular type of substrate or can modify the performance of a thickener. Examples are 2-ethylhexanol, dipropylene glycol monomethyl ether and dipropylene glycol monomethyl ether acetate. This type solvent may make up 1 to 50% by weight of the composition. Preferred are high flash point solvents (typically above about 140° F.) such as N-methyl-2-pyrrolidone, and esters of monoalkyl ethers of dipropylene and tripropylene glycol and esters of monoalkyl ethers of tripropylene glycol. Other nonhalogen-containing solvents which can be used but may be less desirable because of cost, toxicity, odor or volatility are $C_1$ to $C_{12}$ alcohols, including methanol, ethanol, isopropanol and benzyl alcohol; glycols, ether and ethers of ethylene and propylene glycols and their esters; $C_3$ to $C_{12}$ ketones including acetone, diacetone alcohol, methyl ethyl ketone, and acetophenone; acetate esters of $C_1$ to $C_{12}$ aliphatic alcohols; organic nitriles including acetonitrile and benzonitrile; nitropropane; propylene carbonate and ethyl-3-ethoxyproprionate. The second type of solvent is a high flash point, highly aromatic blend of hydrocarbons often referred to as "aromatic naphtha". Such solvents are known in the art and typically contain $C_8$ and higher alkyl benzenes and/or naphthalenes. The second type of solvent may make up 10 to 60 weight percent of the composition.

Surfactants may further be employed with the composition though typically unnecessary. When employed, they are included principally to enhance the water wash of the substrate to remove the paint residue and other undesired ingredients from the surface being cleaned. Either ionic or non-ionic surfactants may be used. Illustrative of classes of stable surfactants are nonionics such as the ethylene oxides condensates such as of alkylphenols or fatty alcohols and lignosulfonates, ammonium salts of mixtures of aromatic sulphone sulphonic acids condensed with formaldehyde; anionic surfactants such as 1-hydroxyethyl-2-heptadecenyl gloxalidin as well as amine oxide surfactant. When used, concentration of surfactant should be at least about 0.05, generally at least about 0.1, and preferably at least about 0.2 weight percent of the aqueous composition.

The composition of the invention may further contain a thickener. Suitable thickeners include ethylcellulose, hydroxypropyl cellulose, organic modified clay and hydrogenated castor oil. When employed, the amount of thickener is between from about 0.5 to about 10 weight percent. Typically, a thickener is added when the formulation is to be used on a surface which is so steep that a less viscous product would flow off of the substrate too quickly, such as from a wall or a vertical sign.

The composition of the invention is effective in removing both water soluble and organic solvent soluble materials. It is particularly effective in the cleaning of surfaces of metal, wood and plastic. Suitable surfaces for cleaning using the composition of the invention include street signs and freeway signs, such as reflectively silk screened, high intensity surfaces, and surfaces coated with protective materials, glass, iron work, steel, stainless steel, aluminum and other metals and alloys, plastic, such as plexiglass and fiberglass; and wood, especially denser woods as well as tile glazed and unglazed, linoleum. The list is not intended to be exhaustive, but instead to be illustrative of the wide range of utility of this invention.

The invention is further useful in automobile refinish shops, i.e., for the cleaning of the surface of an automobile or other vehicle prior to repair and/or repainting. Application of the composition may be by hand and may be accomplished by soaking a cloth with it and then wiping the surface to be cleaned in order to loosen/lift any soil or dirt. This preferably should be followed immediately by wiping with a clean, dry cloth to remove the cleaning composition and the soil. The composition can also be applied to the surface with a spray bottle. In this case, the surface to be cleaned may be sprayed generously with the cleaning composition, wiped with a cloth to loosen/lift the soil and then immediately wiped dry with a clean, dry cloth. In the case of hard to remove soils such as tar, tree sap and the like, it is advisable to wet the surface well with the cleaning composition, allow the surface to remain wet for a couple of minutes, and then to wipe to loosen and lift the soil and wipe dry with a clean, dry cloth.

The composition of the invention is further useful in the removal of grease, oils, paint films and other difficult to remove organic materials.

The composition of the invention is also capable of dissolving polymers, such as polystyrene and, as such, finds particular applicability, in the treatment of waste materials, such as disposable dinnerware, composed of polystyrene.

The following examples will illustrate the practice of the present invention in its preferred embodiments. Other embodiments within the scope of the claims herein will be apparent to one skilled in the art from consideration of the specification and practice of the invention as disclosed herein. It is intended that the specification, together with the examples, be considered exemplary only, with the scope and spirit of the invention being indicated by the claims which follow.

EXAMPLE 1

At 40% solution of ammonium pelargonate was prepared by slowly adding 33 g. of 28% ammonium hydroxide to stirred mixture of 89.3 g. of nonanoic acid (commercial perlargonic acid from Cognis Corp.) and 124.6 g. of deionized water. The solution was clear and had a pH of 7. To this. solution was added with stirring 82.3 g. of DuPont DBE. All of the DBE dissolved to give another clear solution. The final solvent composition contained 25% DBE, 30% ammonium pelargonate and 45% water.

EXAMPLE 2

A portion of a wooden surface that had been painted three times over a period of 30 years was coated with some of the solvent prepared in Example 1. After several hours, the paint on the treated portion was wrinkled and swollen. The top and second layer of paint could easily be removed by scrapping with a putty knife. The unremoved layer was coated again with the Example 1 solvent. In another two hours the bottom layer could be scrapped off to the bare wood. Rinsing with water removed excess solvent.

From the foregoing, it will be observed that numerous variations and modifications may be effected without departing from the true spirit and scope of the novel concepts of the invention.

What is claimed is:

1. An aqueous composition comprising:

(a) ammonium pelargonate; and (b) a carboxylic acid diester of the formula:

$$ROOC(CH_2)_nCOOR' \quad (II)$$

wherein R and R' are independently selected from a $C_1$ to $C_8$ alkyl group and n is from 1 to 8.

2. The aqueous composition of claim 1, wherein the compound of formula (II) is a $C_1$–$C_4$ dialkyl ester of a $C_4$ to $C_6$ aliphatic dibasic acid.

3. The aqueous composition of claim 4, wherein the carboxylic acid diester of (b) is a mixture of adipic acid, glutaric acid, succinic acid or combinations thereof.

4. The aqueous composition of claim 5, wherein the carboxylic acid diester of (b) is a mixture of dimethyl adipate, dimethyl glutarate and dimethyl succinate.

5. The aqueous composition of claim 5, wherein the carboxylic acid diester of (b) is a mixture containing between from about 20 to about 25 weight percent dimethyl adipate; about 55 to about 75 weight percent dimethyl glutarate; and between from about 15 to about 25 weight percent dimethyl succinate.

6. The aqueous composition of claim 1, wherein R and R' are the same $C_1$ to $C_8$ alkyl group.

7. The process of claim 12, wherein the formula (II) is a mixture of two or more carboxylic acid diesters wherein n is between from 1 to about 4.

8. A process of removing paint from a metal, plastic or wood surface which comprises contacting the surface with an aqueous composition consisting of:

(a) at least one compound represented by the formula:

$$R_1COO^-X^+ \quad (I)$$

wherein $R_1$ is a $C_6$ to $C_{19}$ hydrocarbyl group, optionally substituted with one or more hydroxyl or $C_1$–$C_5$ hydrocarbyl groups; X is ammonium or an alkali metal;

(b) a carboxylic acid diester of the formula:

$$ROOC(CH_2)_nCOOR' \quad (II)$$

wherein R and R' are independently selected from a $C_1$ to $C_8$ alkyl group and n is from 1 to 8; and (c) water.

9. The method of claim 8, wherein $R_1$ in formula (I) is a $C_7$ to $C_{11}$ saturated hydrocarbyl group.

10. The method of claim 8, wherein $R_1$ in the compound of formula (I) is a $C_8$, $C_9$, or $C_{10}$ hydrocarbyl group.

11. The aqueous composition of claim 1, wherein the carboxylic acid diester of (b) is a mixture of two or more compounds of the formula $ROOC(CH_2)_nCOOR'$.

* * * * *

UNITED STATES PATENT AND TRADEMARK OFFICE

CERTIFICATE OF CORRECTION

PATENT NO. : 6,624,128 B1
DATED : September 23, 2003
INVENTOR(S) : Robert A. Smiley, Ph.D.

It is certified that error appears in the above-identified patent and that said Letters Patent is hereby corrected as shown below:

Column 5,
Line 6, delete "An" and insert therein -- A process of removing paint from a metal, plastic or wood surface which comprises contacting the surface with an --
Lines 12, 15, 18, 21 and 27, delete "aqueous composition" and insert therein -- method --
Line 15, delete "4" and insert therein -- 11 --
Line 18, delete "5" and insert therein -- 3 --
Line 21, delete "5" and insert therein -- 4 --

Column 6,
Line 1, delete "process" and insert therein -- method --
Line 1, delete "12" and insert therein -- 1 --
Lines 4-5, delete "removing paint from a metal, plastic or wood" and insert therein -- cleaning a hard surface --
Line 21, delete "aqueous composition" and insert therein -- method --
Line 21, delete "1" and insert therein -- 8 --

Signed and Sealed this

Second Day of March, 2004

JON W. DUDAS
*Acting Director of the United States Patent and Trademark Office*